US012110891B2

(12) United States Patent
Kakimoto et al.

(10) Patent No.: US 12,110,891 B2
(45) Date of Patent: Oct. 8, 2024

(54) SCROLL COMPRESSOR

(71) Applicant: KABUSHIKI KAISHA TOYOTA JIDOSHOKKI, Kariya (JP)

(72) Inventors: Kenji Kakimoto, Kariya (JP); Ken Namiki, Kariya (JP); Shiori Yamamoto, Kariya (JP); Kunihisa Matsuda, Kariya (JP); Yuya Hattori, Kariya (JP); Takuro Yamashita, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 18/442,300

(22) Filed: Feb. 15, 2024

(65) Prior Publication Data

US 2024/0295219 A1 Sep. 5, 2024

(30) Foreign Application Priority Data

Mar. 2, 2023 (JP) ..... 2023-031999

(51) Int. Cl.
*F04C 2/02* (2006.01)

(52) U.S. Cl.
CPC ..... *F04C 2/025* (2013.01); *F04C 2240/30* (2013.01)

(58) Field of Classification Search
CPC ..... F04C 18/0215; F04C 18/0253; F04C 23/008; F04C 27/005; F04C 29/0021; F04C 2240/56; F04C 2240/807; F04C 28/24; F04C 29/0057
See application file for complete search history.

(56) References Cited

U.S. PATENT DOCUMENTS

2020/0309126 A1 10/2020 Hattori et al.
2020/0309127 A1 10/2020 Koike et al.

FOREIGN PATENT DOCUMENTS

JP 2020-159314 A 10/2020
JP 2020-165309 A 10/2020

*Primary Examiner* — Anthony Ayala Delgado
(74) *Attorney, Agent, or Firm* — Sughrue Mion, PLLC

(57) ABSTRACT

A fixed outer circumferential wall of a fixed scroll, a movable scroll, and a plate define a suction pressure space configured such that fluid flows from a suction chamber into the suction pressure space. The movable scroll and an opposed wall define a first back-pressure space. The plate and a back-pressure-chamber-defining recess of the opposed wall define a second back-pressure space. A back-pressure supplying groove of the opposed wall is configured to connect the first back-pressure space to the second back-pressure space, thereby supplying the fluid from the first back-pressure space to the second back-pressure space. A discharge hole of the plate is configured to connect the second back-pressure space to the suction pressure space, thereby discharging the fluid from the second back-pressure space to the suction pressure space. At least part of the discharge hole is overlapped with the back-pressure supplying groove in an axial direction.

6 Claims, 3 Drawing Sheets

SCROLL COMPRESSOR

BACKGROUND

1. Field

The present disclosure relates to a scroll compressor.

2. Description of Related Art

Japanese Laid-Open Patent Publication No. 2020-159314 discloses a scroll compressor that includes a housing, a rotary shaft, a fixed scroll, a movable scroll, an opposed wall, and an annular plate. The housing includes a suction chamber into which fluid is drawn. The rotary shaft is rotationally supported by the housing. The fixed scroll includes a fixed base plate, a fixed volute wall that extends from the fixed base plate, and a cylindrical fixed outer circumferential wall that extends from the fixed base plate and surrounds the fixed volute wall. The fixed scroll is fixed to the housing. The movable scroll includes a movable base plate opposed to the fixed base plate, and a movable volute wall that extends from the movable base plate toward the fixed base plate and meshes with the fixed volute wall. The movable scroll is arranged on the inner side of the fixed outer circumferential wall. The movable scroll orbits about the axis of the rotary shaft as the rotary shaft rotates. The opposed wall is opposed to the movable base plate on the side opposite to the fixed base plate. The plate is arranged between the movable base plate and the opposed wall. The opposed wall includes, on its opposed surface opposed to the plate, an annular back-pressure-chamber-defining recess that is recessed from the plate and a back-pressure supplying groove that is recessed from the plate.

The scroll compressor includes a suction pressure space into which fluid flows from the suction chamber, and a back-pressure chamber that urges the movable scroll toward the fixed scroll. The suction pressure space is defined by the fixed outer circumferential wall, the movable scroll, and the plate. The back-pressure chamber includes a first back-pressure space defined by the movable scroll and the opposed wall, and a second back-pressure space defined by the plate and the back-pressure-chamber-defining recess. The first back-pressure space and the second back-pressure space are connected to each other by the back-pressure supplying groove. The back-pressure supplying groove supplies the fluid from the first back-pressure space to the second back-pressure space.

In a scroll compressor that compresses refrigerant, which is fluid, when the temperature inside the housing is lower than the temperature outside the housing for a relatively long period of time, liquid refrigerant accumulates in the back-pressure chamber. When the scroll compressor is operated in this state, the liquid refrigerant stored in the back-pressure chamber is vaporized so that the pressure in the back-pressure chamber is excessively increased. Increasing the pressure in the back-pressure chamber results in greater sliding resistance between the fixed scroll and the movable scroll and between the movable scroll and the plate.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A scroll compressor according to an aspect of the present disclosure includes a housing including a suction chamber configured to draw in fluid, a rotary shaft rotationally supported by the housing, a fixed scroll fixed to the housing, a movable scroll configured to orbit about a rotation axis of the rotary shaft as the rotary shaft rotates, an opposed wall located on an opposite side of the movable scroll from the fixed scroll and opposed to the movable scroll, and an annular plate arranged between the movable scroll and the opposed wall. The fixed scroll includes a fixed base plate, a fixed volute wall that extends from the fixed base plate, and a cylindrical fixed outer circumferential wall that extends from the fixed base plate and surrounds the fixed volute wall. The movable scroll includes a movable base plate opposed to the fixed base plate and a movable volute wall that extends from the movable base plate toward the fixed base plate and meshes with the fixed volute wall. The movable scroll is arranged on an inner side of the fixed outer circumferential wall. The opposed wall includes an opposed surface opposed to the plate, an annular back-pressure-chamber-defining recess that is recessed from the opposed surface, and a back-pressure supplying groove that is recessed from the opposed surface. The plate includes a discharge hole that extends through the plate. The fixed outer circumferential wall, the movable scroll, and the plate define a suction pressure space configured such that the fluid flows from the suction chamber into the suction pressure space. The movable scroll and the opposed wall define a first back-pressure space. The plate and the back-pressure-chamber-defining recess define a second back-pressure space. The first back-pressure space and the second back-pressure space define a back-pressure chamber configured such that the fluid is drawn into the back-pressure chamber to urge the movable scroll toward the fixed scroll. The back-pressure supplying groove is configured to connect the first back-pressure space to the second back-pressure space, thereby supplying the fluid from the first back-pressure space to the second back-pressure space. The discharge hole is configured to connect the second back-pressure space to the suction pressure space, thereby discharging the fluid from the second back-pressure space to the suction pressure space. A least part of the discharge hole is overlapped with the back-pressure supplying groove in an axial direction of the rotary shaft.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the modes, devices, and/or systems described. Modifications and equivalents of the modes, devices, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

An embodiment of a scroll compressor will now be described with reference to FIGS. 1 to 4. The scroll compressor of the present embodiment is mounted on a vehicle. The scroll compressor of the present embodiment is used in a vehicle air conditioner. The scroll compressor of the present embodiment compresses refrigerant, which is fluid.

Figure 1:
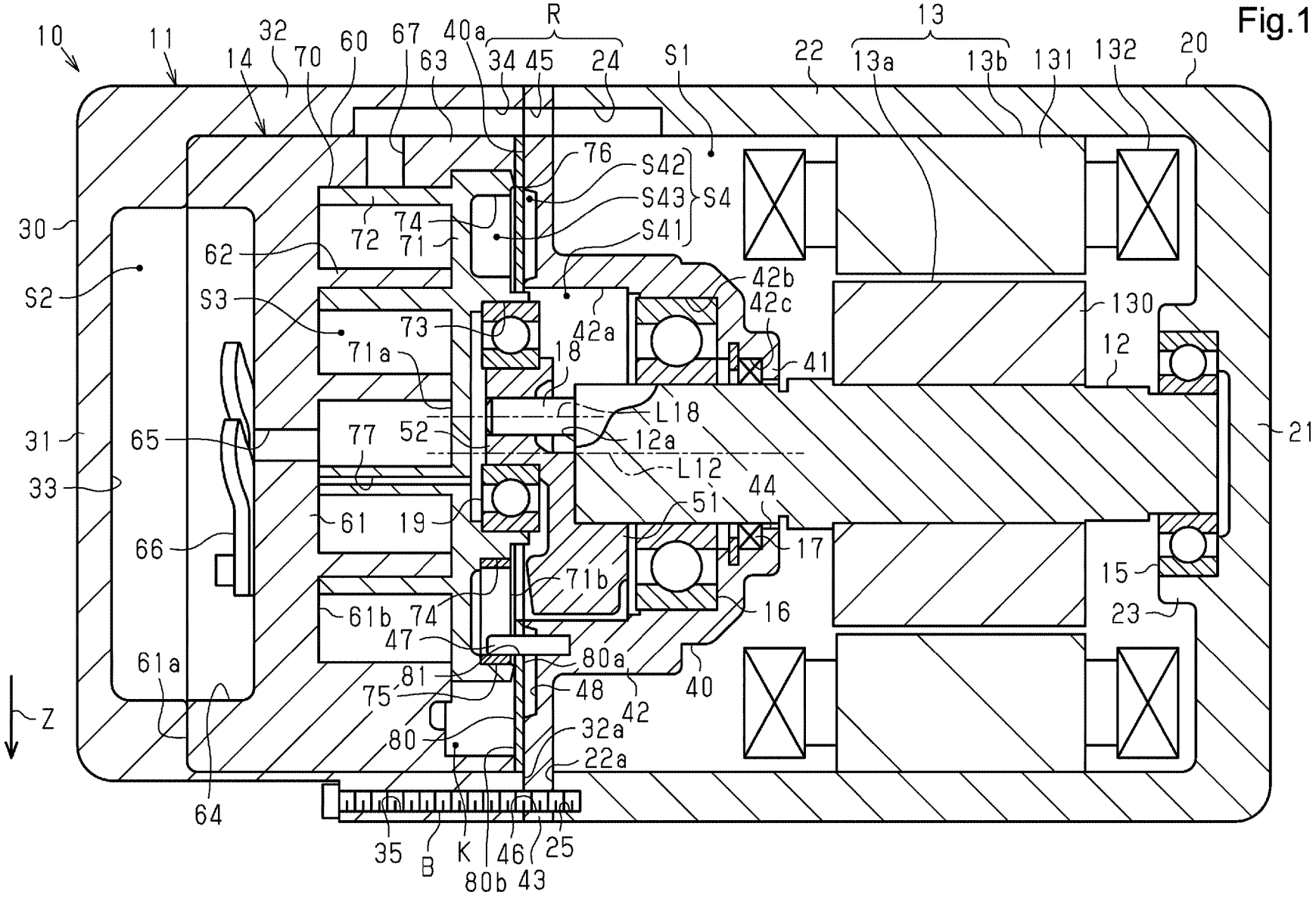
FIG. 1 is a cross-sectional view showing a scroll compressor according to an embodiment.

As shown in FIG. 1, the scroll compressor 10 includes a housing 11, a rotary shaft 12, an electric motor 13, and a compression portion 14.

Housing

The housing 11 accommodates the rotary shaft 12, the electric motor 13, and the compression portion 14. The housing 11 is made of metal. The housing 11 of the present embodiment is made of aluminum. The housing 11 includes a motor housing member 20, a discharge housing member 30, and a shaft support housing member 40.

The motor housing member 20 has a cylindrical shape with a closed end. The motor housing member 20 includes a plate-shaped end wall 21 and a cylindrical circumferential wall 22 that extends from an outer circumferential portion of the end wall 21. The motor housing member 20 includes a cylindrical boss 23. The boss 23 protrudes from the inner surface of the end wall 21.

The motor housing member 20 includes first connection passage-forming recesses 24. FIG. 1 illustrates one of the first connection passage-forming recesses 24. The first connection passage-forming recesses 24 are arranged at intervals in the circumferential direction of the circumferential wall 22 of the motor housing member 20. The first connection passage-forming recesses 24 are recessed from the inner circumferential surface of the circumferential wall 22 of the motor housing member 20. The first connection passage-forming recesses 24 are located on the side of the opening of the circumferential wall 22 of the motor housing member 20. The first connection passage-forming recesses 24 open in a distal end surface 22*a* of the circumferential wall 22 of the motor housing member 20.

The motor housing member 20 includes internal threaded holes 25. FIG. 1 illustrates one of the internal threaded holes 25. The internal threaded holes 25 are arranged at intervals in the circumferential direction of the circumferential wall 22 of the motor housing member 20. The internal threaded holes 25 are located at positions different from those of the first connection passage-forming recesses 24 in the circumferential direction of the circumferential wall 22 of the motor housing member 20. The internal threaded holes 25 open in the distal end surface 22*a* of the circumferential wall 22 of the motor housing member 20.

The discharge housing member 30 has a cylindrical shape with a closed end. The discharge housing member 30 includes a plate-shaped end wall 31 and a cylindrical circumferential wall 32 that extends from an outer circumferential portion of the end wall 31.

The discharge housing member 30 includes a first discharge-chamber-defining recess 33. The first discharge-chamber-defining recess 33 is recessed from the inner surface of the end wall 31 of the discharge housing member 30.

The discharge housing member 30 includes second connection passage-forming recesses 34. FIG. 1 illustrates one of the second connection passage-forming recesses 34. The second connection passage-forming recesses 34 are arranged at intervals in the circumferential direction of the circumferential wall 32 of the discharge housing member 30. The second connection passage-forming recesses 34 are recessed from the inner circumferential surface of the circumferential wall 32 of the discharge housing member 30. The second connection passage-forming recesses 34 are located on the side of the opening of the circumferential wall 32 of the discharge housing member 30. The second connection passage-forming recesses 34 open in a distal end surface 32*a* of the circumferential wall 32 of the discharge housing member 30.

The discharge housing member 30 includes first bolt insertion holes 35. FIG. 1 illustrates one of the first bolt insertion holes 35. The first bolt insertion holes 35 are arranged at intervals in the circumferential direction of the circumferential wall 32 of the discharge housing member 30. The first bolt insertion holes 35 are located at positions different from those of the second connection passage-forming recesses 34 in the circumferential direction of the circumferential wall 32 of the discharge housing member 30. The first bolt insertion holes 35 extend through the circumferential wall 32 of the discharge housing member 30 in the axial direction.

The motor housing member 20 includes a suction port (not shown). Further, the discharge housing member 30 includes a discharge port (not shown). The suction port is connected to one end of an external refrigerant circuit (not shown), and the discharge port is connected to the other end of the external refrigerant circuit.

The shaft support housing member 40 has a cylindrical shape with a closed end. The shaft support housing member 40 includes a plate-shaped end wall 41, a cylindrical circumferential wall 42 extending from an outer circumferential portion of the end wall 41, and an annular flange wall 43. The flange wall 43 extends radially outward from the distal end of the circumferential wall 42 of the shaft support housing member 40.

The inner circumferential surface of the circumferential wall 42 of the shaft support housing member 40 includes a large-diameter inner circumferential surface 42*a*, an intermediate-diameter inner circumferential surface 42*b*, which has a smaller diameter than the large-diameter inner circumferential surface 42*a*, and a small-diameter inner circumferential surface 42*c*, which has a smaller diameter than the intermediate-diameter inner circumferential surface 42*b*. The large-diameter inner circumferential surface 42*a*, the intermediate-diameter inner circumferential surface 42*b*, and the small-diameter inner circumferential surface 42*c* are arranged in this order from the opening end of the shaft support housing member 40 toward the end wall 41.

The shaft support housing member 40 includes a shaft insertion hole 44. The shaft insertion hole 44 extends through the end wall 41 of the shaft support housing member 40 in the axial direction.

Figure 2A:
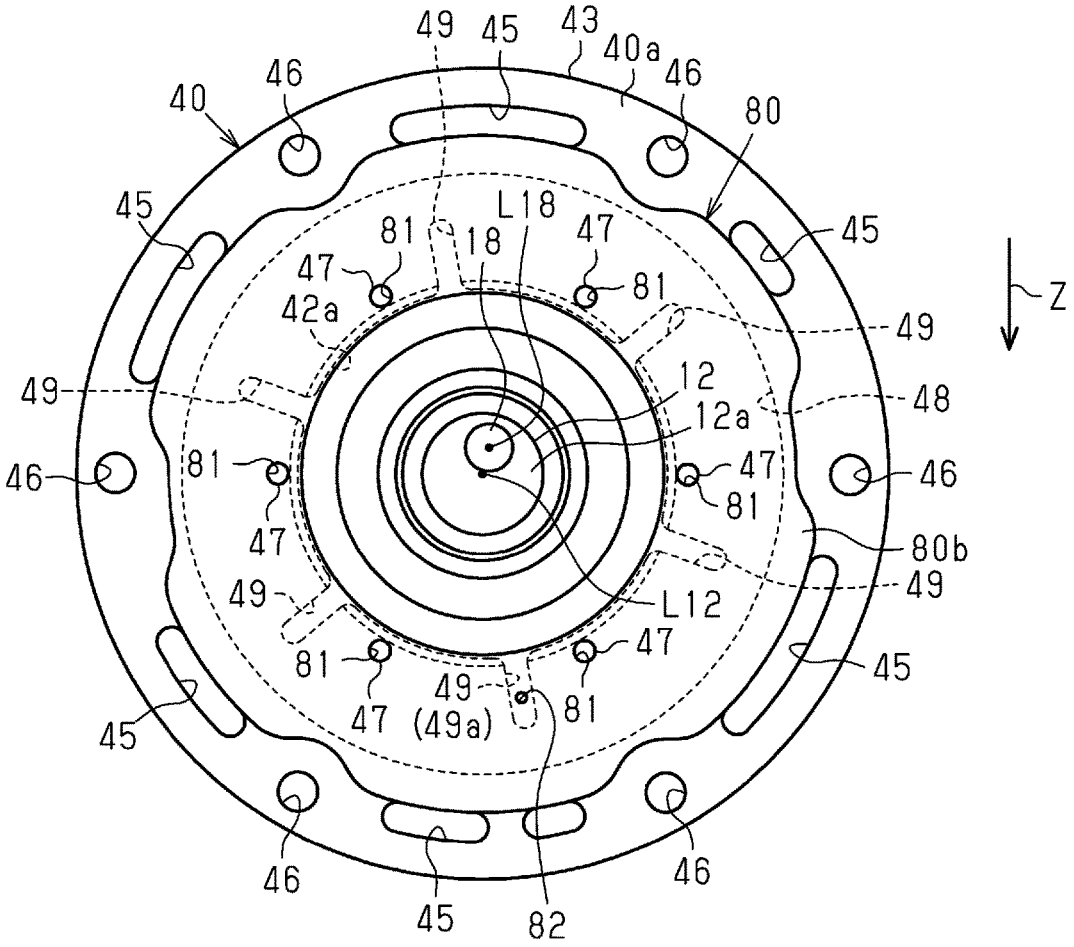
FIG. 2A is a front view of the shaft support housing member, the plate, and the rotary shaft of the scroll compressor shown in FIG. 1.

As shown in FIG. 2A, the shaft support housing member 40 includes connection passage-forming holes 45. The connection passage-forming holes 45 are arranged at intervals in the circumferential direction of the flange wall 43. The connection passage-forming holes 45 extend through the outer circumferential portion of the flange wall 43 in the axial direction of the circumferential wall 42. Further, the shaft support housing member 40 includes second bolt insertion holes 46. The second bolt insertion holes 46 are arranged at intervals in the circumferential direction of the flange wall 43. The second bolt insertion holes 46 are located at positions different from those of the connection passage-forming holes 45 in the circumferential direction of the flange wall 43. The second bolt insertion holes 46 extend through the outer circumferential portion of the flange wall 43 in the axial direction of the circumferential wall 42.

As shown in FIG. 1, the motor housing member 20 and the discharge housing member 30 are arranged such that the distal end surface 22*a* of the circumferential wall 22 of the motor housing member 20 faces the distal end surface 32*a* of the circumferential wall 32 of the discharge housing member 30. The axial direction of the circumferential wall 22 of the motor housing member 20 coincides with the axial direction of the circumferential wall 32 of the discharge housing member 30.

The shaft support housing member 40 is located between the motor housing member 20 and the discharge housing member 30. The axial direction of the circumferential wall 42 of the shaft support housing member 40 coincides with the axial direction of the circumferential wall 22 of the motor housing member 20 and the axial direction of the circumferential wall 32 of the discharge housing member 30. That is, the motor housing member 20, the discharge housing member 30, and the shaft support housing member 40 are arranged on the same axis. The circumferential wall 42 of the shaft support housing member 40 extends from the end wall 41 toward the discharge housing member 30. The flange wall 43 is located between the circumferential wall 22 of the motor housing member 20 and the circumferential wall 32 of the discharge housing member 30. The shaft support housing member 40 includes an end surface 40*a* that is opposed to the distal end surface 32*a* of the circumferential wall 32 of the discharge housing member 30.

The first connection passage-forming recess 24 of the motor housing member 20, the connection passage-forming hole 45 of the shaft support housing member 40, and the second connection passage-forming recess 34 of the discharge housing member 30 are aligned in the axial direction of the circumferential walls 22, 32, 42. The first connection passage-forming recess 24, the connection passage-forming hole 45, and the second connection passage-forming recess 34 define a connection passage R.

The internal threaded holes 25 of the motor housing member 20, the second bolt insertion holes 46 of the shaft support housing member 40, and the first bolt insertion holes 35 of the discharge housing member 30 are aligned in the axial direction of the circumferential walls 22, 32, 42. Bolts B respectively inserted into the first bolt insertion holes 35 and the second bolt insertion holes 46 are fastened into the internal threaded holes 25 so that the motor housing member 20, the shaft support housing member 40, and the discharge housing member 30 are coupled to each other. The flange wall 43 is held between the circumferential wall 22 of the motor housing member 20 and the circumferential wall 32 of the discharge housing member 30.

The housing 11 includes a motor chamber S1. The motor chamber S1 is defined by the end wall 21 of the motor housing member 20, the circumferential wall 22, and the shaft support housing member 40. Refrigerant is drawn into the motor chamber S1 from the external refrigerant circuit through the suction port. The motor chamber S1 is thus a suction chamber into which refrigerant is drawn.

As shown in FIGS. 1 and 2A, the shaft support housing member 40 includes pins 47. The shaft support housing member 40 of the present embodiment includes six pins 47. The pins 47 are arranged at equal intervals in the circumferential direction of the flange wall 43. The shaft support housing member 40 includes an annular back-pressure-chamber-defining recess 48. The back-pressure-chamber-defining recess 48 is recessed from the end surface 40*a* of the shaft support housing member 40. Each pin 47 protrudes from the bottom surface of the back-pressure-chamber-defining recess 48.

Figure 3:
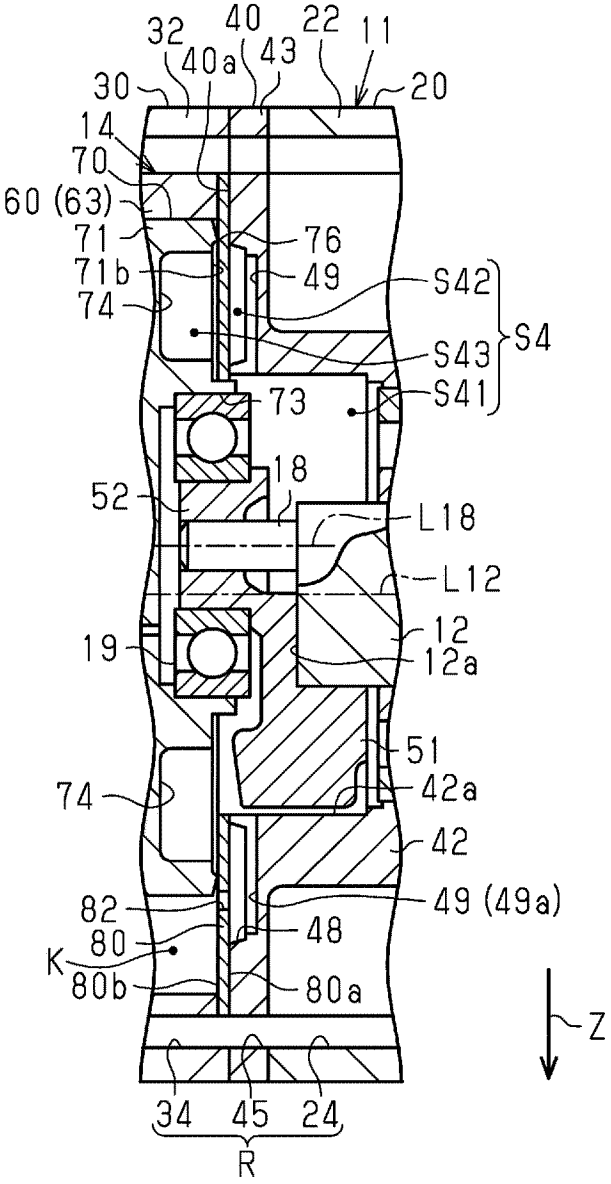
FIG. 3 is a partial cross-sectional view of the scroll compressor shown in FIG. 1 when the discharge hole is in a discharge state.

As shown in FIGS. 2A and 3, the shaft support housing member 40 includes back-pressure supplying grooves 49. The shaft support housing member 40 of the present embodiment includes six back-pressure supplying grooves 49. The back-pressure supplying grooves 49 are arranged at equal intervals in the circumferential direction of the flange wall 43. The back-pressure supplying grooves 49 are located at positions different from those of the pins 47 in the circumferential direction of the flange wall 43. The back-pressure supplying grooves 49 and the pins 47 are alternately arranged in the circumferential direction of the flange wall 43.

As shown in FIG. 3, the back-pressure supplying grooves 49 are recessed from the end surface 40*a* of the shaft support housing member 40. In the present embodiment, the depth from the end surface 40*a* of the shaft support housing member 40 to the bottom surface of each back-pressure supplying groove 49 is greater than the depth from the end surface 40*a* of the shaft support housing member 40 to the bottom surface of the back-pressure-chamber-defining recess 48. The back-pressure supplying grooves 49 of the present embodiment are grooves that extend straight in the radial direction of the flange wall 43.

Each back-pressure supplying groove 49 opens in the large-diameter inner circumferential surface 42*a* of the circumferential wall 42 of the shaft support housing member 40. Each back-pressure supplying groove 49 extends from the large-diameter inner circumferential surface 42*a* of the circumferential wall 42 of the shaft support housing member 40 to a position overlapping with the back-pressure-chamber-defining recess 48. The back-pressure supplying grooves 49 are connected to the back-pressure-chamber-defining recess 48.

Rotary Shaft

As shown in FIG. 1, the rotary shaft 12 is accommodated in the motor chamber S1. The axial direction of the rotary shaft 12 coincides with the axial direction of the circumferential wall 22 of the motor housing member 20. The scroll compressor 10 of the present embodiment is mounted on a vehicle in an orientation where the axial direction of the rotary shaft 12 is orthogonal to the gravitational direction Z.

The first end of the rotary shaft 12 in the axial direction is inserted into the boss 23 of the motor housing member 20. A first bearing 15 is disposed between the outer circumferential surface of the rotary shaft 12 and the inner circumferential surface of the boss 23. The first bearing 15 is a rolling-element bearing. The first end of the rotary shaft 12 is rotationally supported by the motor housing member 20 with the first bearing 15.

The rotary shaft 12 is inserted into the shaft insertion hole 44 of the shaft support housing member 40. The second end of the rotary shaft 12 on the side opposite to the first end protrudes into the shaft support housing member 40. A second bearing 16 is disposed between the outer circumferential surface of the rotary shaft 12 and the intermediate-diameter inner circumferential surface 42*b* of the shaft support housing member 40. The second bearing 16 is a rolling-element bearing. The second end of the rotary shaft 12 is rotationally supported by the shaft support housing member 40 with the second bearing 16.

As shown in FIG. 2A, three of the six back-pressure supplying grooves 49 in the shaft support housing member 40 are located below the rotary shaft 12 in the gravitational direction Z. The remaining three back-pressure supplying grooves 49 are located above the rotary shaft 12 in the gravitational direction Z.

As shown in FIG. 1, a seal member 17 is disposed between the outer circumferential surface of the rotary shaft 12 and the small-diameter inner circumferential surface 42*c* of the shaft support housing member 40. The seal member 17 seals the space between the outer circumferential surface of the rotary shaft 12 and the small-diameter inner circumferential surface 42*c* of the shaft support housing member 40. The seal member 17 restricts leakage of refrigerant from a first back-pressure space S41, which will be discussed below, to the motor chamber S1.

An eccentric shaft 18 is provided integrally with a shaft end surface 12*a* on the second end of the rotary shaft 12. The eccentric shaft 18 rotates integrally with the rotary shaft 12. The axial direction of the eccentric shaft 18 is parallel to the axial direction of the rotary shaft 12. An axis L18 of the eccentric shaft 18 is located at a position eccentric to an axis L12 of the rotary shaft 12.

A bushing 52 having a balance weight 51 is fitted to the outer circumferential surface of the eccentric shaft 18. The balance weight 51 is provided integrally with the bushing 52. The balance weight 51 is accommodated inside the large-diameter inner circumferential surface 42*a* of the shaft support housing member 40.

Electric Motor

The electric motor 13 rotates the rotary shaft 12. The electric motor 13 is accommodated in the motor chamber S1. The electric motor 13 includes a rotor 13*a* and a cylindrical stator 13*b*.

The rotor 13*a* includes a cylindrical rotor core 130 and permanent magnets (not shown). The rotary shaft 12 is inserted through the rotor core 130. The rotary shaft 12 is fixed to the rotor core 130. The permanent magnets are embedded in the rotor core 130. The stator 13*b* is located on the outer side of the rotor 13*a*. The stator 13*b* includes a cylindrical stator core 131 and a coil 132. The outer circumferential surface of the stator core 131 is fixed to the inner circumferential surface of the circumferential wall 22 of the motor housing member 20. The coil 132 is wound around the stator core 131. When the coil 132 is supplied with power, a rotating magnetic field is generated in the stator 13*b*, thereby rotating the rotor 13*a*. The rotary shaft 12 rotates integrally with the rotor 13*a*.

Compression Portion

The compression portion 14 compresses refrigerant when the rotary shaft 12 rotates. The electric motor 13 rotates the rotary shaft 12 to drive the compression portion 14. The compression portion 14 is accommodated in a space defined by the end wall 31 of the discharge housing member 30, the circumferential wall 32 of the discharge housing member 30, and the shaft support housing member 40.

The compression portion 14 includes a fixed scroll 60 and a movable scroll 70. The fixed scroll 60 is closer to the end wall 31 of the discharge housing member 30 than the movable scroll 70 in the axial direction of the rotary shaft 12. The movable scroll 70 is closer to the shaft support housing member 40 than the fixed scroll 60 in the axial direction of the rotary shaft 12.

The fixed scroll 60 includes a disc-shaped fixed base plate 61, a fixed volute wall 62, and a cylindrical fixed outer circumferential wall 63. The fixed base plate 61 includes a first surface 61*a* and a second surface 61*b*. The first surface 61*a* and the second surface 61*b* are orthogonal to the thickness direction of the fixed base plate 61. The first surface 61*a* of the fixed base plate 61 is opposed to the inner surface of the end wall 31 of the discharge housing member 30. The second surface 61*b* of the fixed base plate 61 is located on the side opposite to the first surface 61*a* of the fixed base plate 61. The fixed volute wall 62 and the fixed outer circumferential wall 63 extend from the second surface 61*b* of the fixed base plate 61. The fixed outer circumferential wall 63 surrounds the fixed volute wall 62. The fixed scroll 60 is held between the end wall 31 of the discharge housing member 30 and the shaft support housing member 40 to be fixed to the housing 11.

The fixed scroll 60 includes a second discharge-chamber-defining recess 64. The second discharge-chamber-defining recess 64 is recessed from the first surface 61*a* of the fixed base plate 61. The second discharge-chamber-defining recess 64 cooperates with the first discharge-chamber-defining recess 33 of the discharge housing member 30 to define the discharge chamber S2.

The fixed scroll 60 includes a discharge port 65. The discharge port 65 is a through-hole that extends through a central portion of the fixed base plate 61 in the thickness direction. The discharge port 65 opens in the bottom surface of the second discharge-chamber-defining recess 64. A valve mechanism 66 that selectively opens and closes the discharge port 65 is attached to the bottom surface of the second discharge-chamber-defining recess 64.

The fixed scroll 60 includes an inlet hole 67. The inlet hole 67 extends through the fixed outer circumferential wall 63 in the radial direction.

The movable scroll 70 includes a disc-shaped movable base plate 71 and a movable volute wall 72. The movable scroll 70 is arranged on the inner side of the fixed outer circumferential wall 63.

The movable base plate 71 has a first surface 71*a* and a second surface 71*b*. The first surface 71*a* and the second surface 71*b* are orthogonal to the thickness direction of the movable base plate 71. The first surface 71*a* of the movable base plate 71 is opposed to the second surface 61*b* of the fixed base plate 61. The distal end surface of the fixed volute wall 62 is in contact with the first surface 71*a* of the movable base plate 71. The second surface 71*b* of the movable base plate 71 is located on the side opposite to the first surface 71*a* of the movable base plate 71. The movable volute wall 72 extends from the first surface 71*a* of the movable base plate 71. The movable volute wall 72 extends from the movable base plate 71 toward the fixed base plate 61. The movable volute wall 72 is meshed with the fixed volute wall 62. The distal end surface of the movable volute wall 72 is in contact with the second surface 61*b* of the fixed base plate 61.

The shaft support housing member 40 is an opposed wall that is located on the opposite side of the movable base plate 71 from the fixed base plate 61 and opposed to the movable base plate 71. Thus, the opposed wall is a part of the housing 11.

The fixed base plate 61, the fixed volute wall 62, the movable base plate 71, and the movable volute wall 72 define a compression chamber S3 that compresses refrigerant. The compression chamber S3 is connected to the connection passage R by the inlet hole 67. The refrigerant in the motor chamber S1 is drawn into the compression chamber S3 from the connection passage R through the inlet hole 67. The refrigerant compressed in the compression chamber S3 is discharged to the discharge chamber S2 through the discharge port 65.

The movable scroll 70 includes an accommodating recess 73. The accommodating recess 73 is recessed from the second surface 71*b* of the movable base plate 71. The accommodating recess 73 is located in a central portion of the movable base plate 71. The eccentric shaft 18 and the bushing 52 are accommodated in the accommodating recess 73. A third bearing 19 is arranged between the outer circumferential surface of the bushing 52 and the inner circumferential surface of the accommodating recess 73. The third bearing 19 is a rolling-element bearing. The movable scroll 70 is supported by the eccentric shaft 18 with the third bearing 19 and the bushing 52 so as to be rotatable relative to the eccentric shaft 18.

The movable scroll 70 includes anti-rotation recesses 74. The anti-rotation recesses 74 are spaced apart from each other in the circumferential direction of the movable base plate 71. The anti-rotation recesses 74 are located around the accommodating recess 73. The anti-rotation recesses 74 are recessed from the second surface 71*b* of the movable base plate 71. Each anti-rotation recess 74 has a circular shape. An annular ring member 75 is fitted in the inner circumferential surface of each anti-rotation recess 74. Each pin 47 is inserted into a corresponding ring member 75.

The movable scroll 70 orbits about the rotation axis L12 of the rotary shaft 12 as the rotary shaft 12 rotates. Specifically, the rotation of the rotary shaft 12 is transmitted to the movable scroll 70 through the eccentric shaft 18, the bushing 52, and the third bearing 19. While the movable scroll 70 tends to rotate, the pins 47 respectively come into contact with the inner circumferential surfaces of the ring members 75 to prevent the movable scroll 70 from rotating. The movable scroll 70 is only permitted to orbit about the rotation axis L12 of the rotary shaft 12. The movable scroll 70 orbits about the rotation axis L12 of the rotary shaft 12, with the movable volute wall 72 contacting the fixed volute wall 62 and being prevented from rotating. When the orbiting motion of the movable scroll 70 reduces the volume of the compression chamber S3, the refrigerant drawn into the compression chamber S3 is compressed. The balance weight 51 cancels out the centrifugal force acting on the movable scroll 70 when the movable scroll 70 orbits, thereby reducing the amount of imbalance in the movable scroll 70.

The movable scroll 70 includes an annular protrusion 76. The protrusion 76 protrudes from the second surface 71*b* of the movable base plate 71. The protrusion 76 surrounds the anti-rotation recesses 74.

The movable scroll 70 includes a back-pressure drawing passage 77. The back-pressure drawing passage 77 extends through the movable base plate 71 and the movable volute wall 72 in the axial direction of the rotary shaft 12. One end of the back-pressure drawing passage 77 opens in the distal end surface of the movable volute wall 72, and the other end of the back-pressure drawing passage 77 opens in the bottom surface of the accommodating recess 73.

Plate

An annular plate 80 is disposed between the shaft support housing member 40 and the movable scroll 70. The thickness direction of the plate 80 coincides with the axial direction of the circumferential wall 42 of the shaft support housing member 40 and the direction in which the movable volute wall 72 extends from the movable base plate 71.

The plate 80 includes a first surface 80*a* and a second surface 80*b*. The first surface 80*a* and the second surface 80*b* are orthogonal to the thickness direction of the plate 80. The first surface 80*a* of the plate 80 is opposed to the end surface 40*a* of the shaft support housing member 40. Thus, the end surface 40*a* of the shaft support housing member 40 is an opposed surface of the opposed wall that is opposed to the plate 80. The second surface 80*b* of the plate 80 is located on the side opposite to the first surface 80*a* of the plate 80. The second surface 80*b* of the plate 80 is opposed to the compression portion 14.

A portion of the end surface 40*a* of the shaft support housing member 40 that is on the inner circumferential side of the back-pressure-chamber-defining recess 48 is in contact with the first surface 80*a* of the plate 80. Further, a portion of the end surface 40*a* of the shaft support housing member 40 that is on the outer circumferential side of the back-pressure-chamber-defining recess 48 is in contact with the first surface 80*a* of the plate 80. The protrusion 76 of the movable scroll 70 is in contact with the second surface 80*b* of the plate 80.

The inner diameter of the plate 80 is substantially the same as the diameter of the large-diameter inner circumferential surface 42*a* of the shaft support housing member 40. The inner circumferential edge of the plate 80 is aligned with the large-diameter inner circumferential surface 42*a* in the axial direction of the rotary shaft 12. The back-pressure-chamber-defining recess 48 of the shaft support housing member 40 extends in the circumferential direction of the plate 80. The back-pressure supplying grooves 49 of the shaft support housing member 40 extend in the radial direction of the plate 80.

The fixed outer circumferential wall 63 of the fixed scroll 60, the movable scroll 70, and the plate 80 define a suction pressure space K. The suction pressure space K is connected to the inlet hole 67. Refrigerant in the motor chamber S1 also flows into the suction pressure space K from the connection passage R through the inlet hole 67.

As shown in FIG. 2A, the plate 80 includes pin insertion holes 81. The pin insertion holes 81 are arranged at intervals in the circumferential direction of the plate 80. The pin insertion holes 81 extend through the plate 80 in the thickness direction. Each pin 47 is inserted through a corresponding pin insertion hole 81. The plate 80 includes a discharge hole 82. The discharge hole 82 extends through the plate 80 in the thickness direction.

Figure 2B:
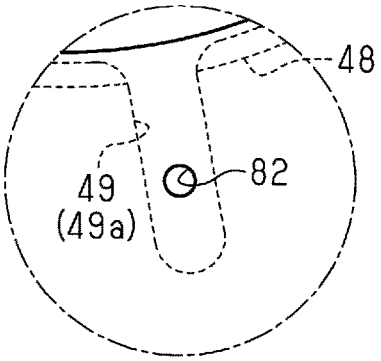
FIG. 2B is an enlarged view showing part of FIG. 2A.

As shown in FIGS. 2B and 3, the discharge hole 82 is overlapped with the back-pressure supplying groove 49 in the axial direction of the rotary shaft 12. In the present embodiment, the discharge hole 82 is overlapped with at least one of the back-pressure supplying grooves 49. Specifically, the discharge hole 82 is overlapped with a back-pressure supplying groove 49*a* of the six back-pressure supplying grooves 49 that is located at the lowermost position in the gravitational direction Z. Thus, the discharge hole 82 is overlapped with the back-pressure supplying groove 49 at a position below the rotary shaft 12 in the gravitational direction Z. In the present embodiment, the entire discharge hole 82 is overlapped with the back-pressure supplying groove 49.

Back-Pressure Chamber

The housing 11 includes a back-pressure chamber S4. The back-pressure chamber S4 includes a first back-pressure space S41, a second back-pressure space S42, and a third back-pressure space S43.

The first back-pressure space S41 is defined by the shaft support housing member 40 and the movable scroll 70. Specifically, the first back-pressure space S41 is defined by the inner circumferential surface of the circumferential wall 42 of the shaft support housing member 40 and the inner surface of the accommodating recess 73 of the movable scroll 70. The first back-pressure space S41 is connected to the compression chamber S3 by the back-pressure drawing passage 77. The back-pressure drawing passage 77 draws refrigerant from the compression chamber S3 into the first back-pressure space S41.

The second back-pressure space S42 is defined by the shaft support housing member 40 and the plate 80. Specifically, the second back-pressure space S42 is defined by the inner surface of the back-pressure-chamber-defining recess 48 of the shaft support housing member 40 and the first surface 80*a* of the plate 80. The second back-pressure space S42 is connected to the first back-pressure space S41 by the back-pressure supplying grooves 49. The back-pressure supplying grooves 49 supply the refrigerant from the first back-pressure space S41 to the second back-pressure space S42.

The portion of the end surface 40*a* of the shaft support housing member 40 that is on the inner circumferential side of the back-pressure-chamber-defining recess 48 comes into contact with the first surface 80*a* of the plate 80, thereby restricting the refrigerant in the first back-pressure space S41 from leaking to the second back-pressure space S42. Further, the portion of the end surface 40*a* of the shaft support housing member 40 that is on the outer circumferential side of the back-pressure-chamber-defining recess 48 comes into contact with the first surface 80*a* of the plate 80, thereby restricting the refrigerant in the second back-pressure space S42 from leaking to the connection passage R.

Figure 4:
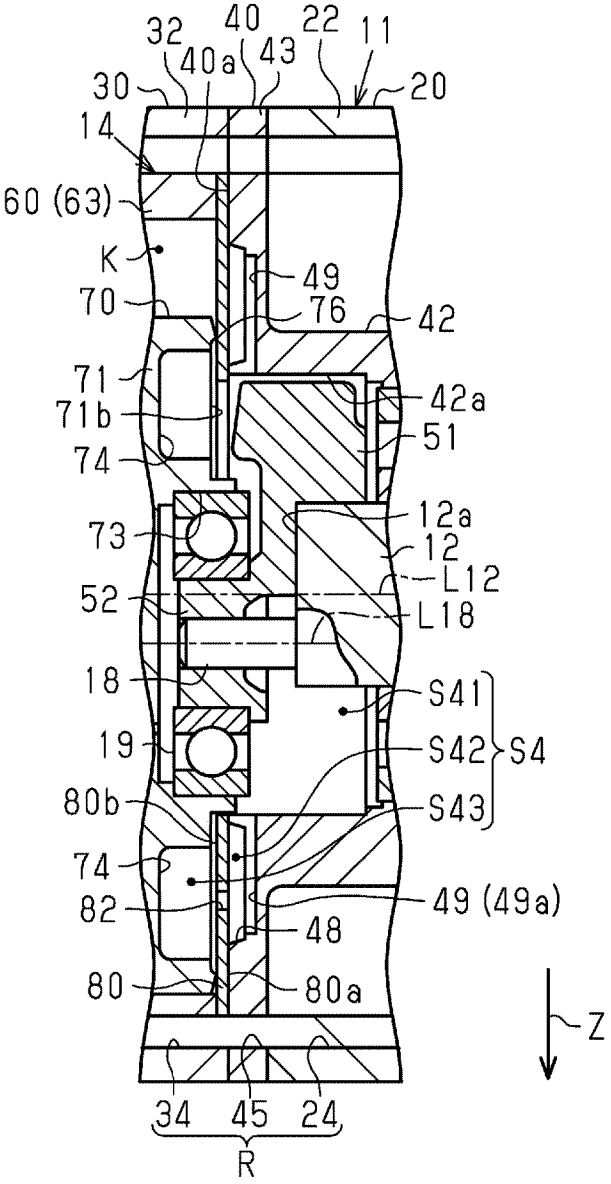
FIG. 4 is a partial cross-sectional view of the scroll compressor shown in FIG. 1 when the discharge hole is in a non-discharge state.

As shown in FIGS. 3 and 4, when the movable scroll 70 orbits about the rotation axis L12 of the rotary shaft 12, the position of the movable scroll 70 relative to the plate 80 changes. As the position of the movable scroll 70 changes, the position of the suction pressure space K, defined by the fixed outer circumferential wall 63 of the fixed scroll 60, the movable scroll 70, and the plate 80, changes. As the position of the suction pressure space K changes, the discharge hole 82 of the plate 80 may enter a discharge state in which the discharge hole 82 is connected to the suction pressure space K as shown in FIG. 3 and may enter a non-discharge state in which the discharge hole 82 is opposed to the movable scroll 70 as shown in FIG. 4. That is, the discharge hole 82 is switched between the discharge state and the non-discharge state depending on the orbiting motion of the movable scroll 70.

As shown in FIG. 3, when the discharge hole 82 is in the discharge state, the second back-pressure space S42 and the suction pressure space K are connected to each other by the discharge hole 82. Accordingly, the refrigerant in the second back-pressure space S42 is discharged to the suction pressure space K from the discharge hole 82. In contrast, as shown in FIG. 4, when the discharge hole 82 is in the non-discharge state, the second back-pressure space S42 is not connected to the suction pressure space K. Accordingly, the refrigerant in the second back-pressure space S42 is not discharged to the suction pressure space K. In this manner, the discharge hole 82 can connect the second back-pressure space S42 to the suction pressure space K. The discharge hole 82 connects the second back-pressure space S42 to the suction pressure space K, thereby discharging the refrigerant from the second back-pressure space S42 to the suction pressure space K.

The third back-pressure space S43 is defined by the movable scroll 70 and the plate 80. Specifically, the third back-pressure space S43 is defined by the inner surface of each anti-rotation recess 74 of the movable scroll 70 and the second surface 80*b* of the plate 80. The third back-pressure space S43 is defined when the opening of the anti-rotation recess 74 of the movable scroll 70 is covered by the plate 80 due to orbiting motion of the movable scroll 70.

The third back-pressure space S43 is connected to the first back-pressure space S41. The third back-pressure space S43 and the second back-pressure space S42 are aligned with the plate 80 in between in the axial direction of the rotary shaft 12. The third back-pressure space S43 is located on the inner circumferential side of the suction pressure space K in the radial direction of the plate 80. The contact of the protrusion 76 of the movable scroll 70 with the plate 80 restricts the refrigerant in the anti-rotation recess 74 from leaking to the suction pressure space K.

The refrigerant compressed in the compression chamber S3 is drawn into the first back-pressure space S41 of the back-pressure chamber S4 through the back-pressure drawing passage 77. The central portion of the movable base plate 71 of the movable scroll 70 is urged toward the fixed scroll 60 by the pressure of the refrigerant drawn into the first back-pressure space S41.

Some of the refrigerant that has been drawn into the first back-pressure space S41 flows into the anti-rotation recess 74 to be drawn into the third back-pressure space S43. An outer circumferential part of the movable base plate 71 of the movable scroll 70 is urged toward the fixed scroll 60 by the pressure of the refrigerant in the third back-pressure space S43. Further, the plate 80 is pressed toward the shaft support housing member 40 by the pressure of the refrigerant in the third back-pressure space S43.

Some of the refrigerant that has been drawn into the first back-pressure space S41 is supplied to the second back-pressure space S42 through the back-pressure supplying grooves 49. The plate 80 is pressed toward the movable scroll 70 by the pressure of the refrigerant in the second back-pressure space S42. The direction in which the refrigerant supplied to the second back-pressure space S42 presses the plate 80 is opposite to the direction in which the refrigerant drawn into the third back-pressure space S43 presses the plate 80. This limits deformation of the plate 80 in the thickness direction. The movable scroll 70 is also urged toward the fixed scroll 60 via the plate 80 by the pressure of the refrigerant in the second back-pressure space S42.

In this manner, the refrigerant compressed in the compression chamber S3 is drawn into the back-pressure chamber S4 so that the back-pressure chamber S4 urges the movable scroll 70 toward the fixed scroll 60. When the movable scroll 70 is urged toward the fixed scroll 60, the distal end surface of the movable volute wall 72 is pressed against the second surface 61*b* of the fixed base plate 61. This ensures the sealing of the compression chamber S3.

Operation of Present Embodiment

The operation of the present embodiment will now be described.

The plate 80 includes the discharge hole 82. The discharge hole 82 extends through the plate 80 in the thickness direction. The discharge hole 82 can connect the second back-pressure space S42 and the suction pressure space K to each other. The discharge hole 82 is overlapped with, in the axial direction of the rotary shaft 12, the back-pressure supplying groove 49*a* of the back-pressure supplying grooves 49 at the lowermost position in the gravitational direction Z. The refrigerant that has flowed from the first back-pressure space S41 to the back-pressure supplying grooves 49 that are not overlapped with the discharge hole 82 is supplied to the second back-pressure space S42. The refrigerant supplied to the second back-pressure space S42 flows in the circumferential direction of the plate 80 along the back-pressure-chamber-defining recess 48 and is then discharged to the suction pressure space K from the discharge hole 82. The refrigerant that has flowed from the first back-pressure space S41 to the back-pressure supplying groove 49*a*, which is overlapped with the discharge hole 82, is discharged to the suction pressure space K from the discharge hole 82 without flowing through the second back-pressure space S42 in the circumferential direction.

In a reference example, the discharge hole 82 is not overlapped with the back-pressure supplying groove 49*a* in the axial direction of the rotary shaft 12. In the reference example, refrigerant is supplied from the first back-pressure space 41 to the second back-pressure space S42 through the back-pressure supplying grooves 49. That refrigerant is discharged to the suction pressure space K from the discharge hole 82 only after flowing in the circumferential direction of the plate 80 along the back-pressure-chamber-defining recess 48. As described above, since the second back-pressure space S42 is a relatively narrow space defined by the plate 80 and the back-pressure-chamber-defining recess 48 of the shaft support housing member 40, the refrigerant is unlikely to flow. That is, in the reference example, the refrigerant in the first back-pressure space S41 is unlikely to be discharged to the suction pressure space K.

In the present embodiment, as described above, the refrigerant that has flowed into the back-pressure supplying groove 49*a*, which is overlapped with the discharge hole 82, from the first back-pressure space S41 is discharged to the suction pressure space K from the discharge hole 82 without flowing through the second back-pressure space S42 in the circumferential direction. Thus, the refrigerant in the first back-pressure space S41 is more likely to be discharged to the suction pressure space K than in the reference example.

Advantages of Present Embodiment

The advantages of the present embodiment will now be described.

(1) The plate 80 includes the discharge hole 82. The discharge hole 82 extends through the plate 80 in the thickness direction. The discharge hole 82 connects the second back-pressure space S42 to the suction pressure space K, thereby discharging refrigerant from the second back-pressure space S42 to the suction pressure space K. The discharge hole 82 is overlapped with, in the axial direction of the rotary shaft 12, a back-pressure supplying groove 49 that connects the first back-pressure space S41 and the second back-pressure space S42 to each other. Thus, the refrigerant that has flowed from the first back-pressure space S41 to the back-pressure supplying groove 49 that is overlapped with the discharge hole 82 is discharged to the suction pressure space K from the discharge hole 82 without flowing through the second back-pressure space S42 in the circumferential direction. Accordingly, as compared with the reference example, in which the discharge hole 82 is not overlapped with the back-pressure supplying groove 49*a* in the axial direction of the rotary shaft 12, the refrigerant in the first back-pressure space S41 is more likely to be discharged to the suction pressure space K. This limits an increase in the sliding resistance between the fixed scroll 60 and the movable scroll 70 that would result from an excessive increase in the pressure in the back-pressure chamber S4, and also limits an increase in the sliding resistance between the movable scroll 70 and the plate 80.

(2) For example, if the discharge hole 82 is only in the non-discharge state, in which the discharge hole 82 is opposed to the movable scroll 70, the back-pressure chamber S4 is not connected to the suction pressure space K. Thus, the refrigerant in the back-pressure chamber S4 is not discharged to the suction pressure space K. If the discharge hole 82 is only in the discharge state, in which the discharge hole 82 is connected to the suction pressure space K, the back-pressure chamber S4 and the suction pressure space K are constantly connected to each other by the discharge hole 82. Thus, when the refrigerant in the back-pressure chamber S4 is excessively discharged to the suction pressure space K, there is a risk that the pressure in the back-pressure chamber S4 is excessively lowered. This risk is particularly significant when the discharge hole 82 is overlaps with the back-pressure supplying groove 49. If the pressure in the back-pressure chamber S4 is excessively lowered, the urging force that urges the movable scroll 70 toward the fixed scroll 60 is insufficient. In the present embodiment, the discharge hole 82 is switched between the discharge state and the non-discharge state depending on the orbiting motion of the movable scroll 70. Accordingly, the refrigerant in the back-pressure chamber S4 is discharged to the suction pressure space K while preventing the pressure in the back-pressure chamber S4 from being excessively lowered.

(3) At the start of the scroll compressor 10, the refrigerant in the first back-pressure space S41 accumulates on the lower side in the gravitational direction Z due to gravity. The scroll compressor 10 of the present embodiment is mounted on a vehicle in an orientation where the discharge hole 82 is located below the rotary shaft 12 in the gravitational direction Z and overlapped with the back-pressure supplying groove 49 in the axial direction of the rotary shaft 12. Accordingly, the refrigerant that has accumulated on the lower side in the gravitational direction Z in the first back-pressure space S41 readily flows to the back-pressure supplying groove 49 that is overlapped with the discharge hole 82. This allows the refrigerant in the first back-pressure space S41 to be readily discharged by the suction pressure space K.

(4) The shaft support housing member 40 has multiple back-pressure supplying grooves 49. The back-pressure supplying grooves 49 are arranged at intervals in the circumferential direction of the plate 80. For example, if the discharge hole 82 is overlapped with all the back-pressure supplying grooves 49 in the axial direction of the rotary shaft 12, an excessive discharge of the refrigerant from the back-pressure chamber S4 to the suction pressure space K may excessively lower the pressure in the back-pressure chamber S4. In the present embodiment, the discharge hole 82 is overlapped with one of the back-pressure supplying grooves 49 in the axial direction of the rotary shaft 12. Thus, the pressure in the back-pressure chamber S4 is likely to be prevented from being excessively lowered by an excessive discharge of the refrigerant from the back-pressure chamber S4 to the suction pressure space K.

(5) The back-pressure supplying grooves 49 of the present embodiment are straight grooves extending in the radial direction of the plate 80. Thus, as compared to a case in which the back-pressure supplying grooves 49 each have a part that extends in the radial direction of the plate 80 and a part that extends in the circumferential direction of the plate 80, the passage from the first back-pressure space S41 to the discharge hole 82 through which refrigerant flows is shortened. This allows the refrigerant in the first back-pressure space S41 to be readily discharged by the suction pressure space K.

(6) In addition to the first back-pressure space S41 and the second back-pressure space S42, the back-pressure chamber S4 includes the third back-pressure space S43, which is defined by the movable scroll 70 and the plate 80 and connected to the first back-pressure space S41. Thus, the outer circumferential part of the movable base plate 71 of the movable scroll 70 is urged toward the fixed scroll 60 by the pressure of the refrigerant in the third back-pressure space S43. That is, the central portion of the movable base plate 71 as well as the outer circumferential part of the movable base plate 71 are urged toward the fixed scroll 60 by the pressure of the refrigerant in the first back-pressure space S41. This allows the movable scroll 70 to be stably urged toward the fixed scroll 60. Further, since the third back-pressure space S43 is connected to the first back-pressure space S41, the volume of the first back-pressure space S41 is substantially increased. Even in this case, the overlap of the discharge hole 82 with the back-pressure supplying groove 49 facilitates the discharging of refrigerant from the first back-pressure space S41 and the third back-pressure space S43 to the suction pressure space K.

Modifications

The above embodiment may be modified as follows. The above embodiment and the following modifications can be combined as long as the combined modifications remain technically consistent with each other.

In the above embodiment, the entire discharge hole 82 is overlapped with the back-pressure supplying groove 49 in the axial direction of the rotary shaft 12. Instead, only part of the discharge hole 82 may be overlapped with the back-pressure supplying groove 49 in the axial direction of the rotary shaft 12. That is, any configuration may be employed if at least part of the discharge hole 82 is overlapped with the back-pressure supplying groove 49 in the axial direction of the rotary shaft 12.

The size of the discharge hole 82 may be changed. The size of the discharge hole 82 is set based on the balance between the amount of refrigerant that is discharged to the suction pressure space K from the back-pressure chamber S4 and the pressure in the back-pressure chamber S4. The larger the size of the discharge hole 82, the greater the amount of refrigerant that is discharged from the back-pressure chamber S4 to the suction pressure space K.

The position of the discharge hole 82 may be changed if the discharge hole 82 is overlapped with the back-pressure supplying groove 49 in the axial direction of the rotary shaft 12. When the position of the discharge hole 82 changes, the ratio of time during which the discharge hole 82 is in the discharge state to time during which the discharge hole 82 is in the non-discharge state changes. The longer the time during which the discharge hole 82 is in the discharge state, the greater the amount of refrigerant discharged from the back-pressure chamber S4 to the suction pressure space K. The position of the discharge hole 82 is set based on the balance between the amount of refrigerant discharged to the suction pressure space K from the back-pressure chamber S4 and the pressure in the back-pressure chamber S4.

In the above embodiment, the shaft support housing member 40 includes multiple back-pressure supplying grooves 49. Instead, the shaft support housing member 40 may include a single back-pressure supplying groove 49.

The plate 80 may have multiple discharge holes 82 respectively overlapped with the back-pressure supplying grooves 49 in the axial direction of the rotary shaft 12. That is, the discharge holes 82 and the back-pressure supplying grooves 49 may be overlapped with each other at multiple positions.

Of the back-pressure supplying grooves 49, the discharge hole 82 may be overlapped, in the axial direction of the rotary shaft 12, with the back-pressure supplying grooves 49 other than the back-pressure supplying groove 49*a*, which is located at the lowermost position in the gravitational direction Z.

The discharge hole 82 may be overlapped, in the axial direction of the rotary shaft 12, with the back-pressure supplying groove 49 at a position above the rotary shaft 12 or at the same height as the rotary shaft 12 in the gravitational direction Z.

The back-pressure supplying grooves 49 do not necessarily need to extend straight in the radial direction of the plate 80 if the refrigerant in the first back-pressure space S41 can be supplied to the second back-pressure space S42 by connecting the first back-pressure space S41 to the second back-pressure space S42. The back-pressure supplying grooves 49 may each have, for example, a part that extends in the radial direction of the plate 80 and a part that extends in the circumferential direction of the plate 80.

Instead of the refrigerant compressed in the compression chamber S3, the refrigerant that has been discharged to the discharge chamber S2 may be drawn into the back-pressure chamber S4.

The opposed wall that is located on the opposite side of the movable base plate 71 from the fixed base plate 61 and opposed to the movable base plate 71 does not necessarily have to be a part of the housing 11. The opposed wall may be a member accommodated in the housing 11.

The scroll compressor 10 does not have to be mounted on a vehicle in an orientation where the axial direction of the rotary shaft 12 is orthogonal to the gravitational direction Z. The direction in which the scroll compressor 10 is mounted on the vehicle may be changed.

The scroll compressor 10 does not have to be driven by the electric motor 13. The scroll compressor 10 may be driven by, for example, the engine of a vehicle.

The scroll compressor 10 does not have to be mounted on a vehicle. The scroll compressor 10 does not have to be used in a vehicle air conditioner. The scroll compressor 10 may be mounted on, for example, a fuel cell electric vehicle. The scroll compressor 10 may use the compression portion 14 to compress air, which is fluid, supplied to the fuel cell.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. A scroll compressor, comprising:

a housing including a suction chamber configured to draw in fluid;

a rotary shaft rotationally supported by the housing;

a fixed scroll fixed to the housing;

a movable scroll configured to orbit about a rotation axis of the rotary shaft as the rotary shaft rotates;

an opposed wall located on an opposite side of the movable scroll from the fixed scroll and opposed to the movable scroll; and an annular plate arranged between the movable scroll and the opposed wall, wherein the fixed scroll includes:

a fixed base plate;

a fixed volute wall that extends from the fixed base plate; and a cylindrical fixed outer circumferential wall that extends from the fixed base plate and surrounds the fixed volute wall, the movable scroll includes:

a movable base plate opposed to the fixed base plate; and a movable volute wall that extends from the movable base plate toward the fixed base plate and meshes with the fixed volute wall, the movable scroll is arranged on an inner side of the fixed outer circumferential wall, the opposed wall includes:

an opposed surface opposed to the plate;

an annular back-pressure-chamber-defining recess that is recessed from the opposed surface; and a back-pressure supplying groove that is recessed from the opposed surface, the plate includes a discharge hole that extends through the plate, the fixed outer circumferential wall, the movable scroll, and the plate define a suction pressure space configured such that the fluid flows from the suction chamber into the suction pressure space, the movable scroll and the opposed wall define a first back-pressure space, the plate and the back-pressure-chamber-defining recess define a second back-pressure space, the first back-pressure space and the second back-pressure space define a back-pressure chamber configured such that the fluid is drawn into the back-pressure chamber to urge the movable scroll toward the fixed scroll, the back-pressure supplying groove is configured to connect the first back-pressure space to the second back-pressure space, thereby supplying the fluid from the first back-pressure space to the second back-pressure space, the discharge hole is configured to connect the second back-pressure space to the suction pressure space, thereby discharging the fluid from the second back-pressure space to the suction pressure space, and at least part of the discharge hole is overlapped with the back-pressure supplying groove in an axial direction of the rotary shaft.

2. The scroll compressor according to claim 1, wherein the discharge hole is configured to be switched between a discharge state in which the discharge hole is connected to the suction pressure space and a non-discharge state in which the discharge hole is opposed to the movable scroll as the movable scroll orbits.

3. The scroll compressor according to claim 1, wherein the scroll compressor is arranged in an orientation where the discharge hole is located below the rotary shaft in a gravitational direction and overlapped with the back-pressure supplying groove in the axial direction of the rotary shaft.

4. The scroll compressor according to claim 1, wherein the back-pressure supplying groove is one of back-pressure supplying grooves on the opposed wall, the back-pressure supplying grooves are arranged at intervals in a circumferential direction of the plate, and the discharge hole is overlapped with at least one of the back-pressure supplying grooves in the axial direction of the rotary shaft.

5. The scroll compressor according to claim 1, wherein the back-pressure supplying grooves are straight grooves that extend in a radial direction of the plate.

6. The scroll compressor according to claim 1, wherein the movable scroll and the plate define a third back-pressure space connected to the first back-pressure space.

* * * * *